US010875609B1

(12) United States Patent
Hawkes

(10) Patent No.: US 10,875,609 B1
(45) Date of Patent: Dec. 29, 2020

(54) BOAT STEP APPARATUS

(71) Applicant: Graham Sidney Hawkes, Point Richmond, CA (US)

(72) Inventor: Graham Sidney Hawkes, Point Richmond, CA (US)

( * ) Notice: Subject to any disclaimer, the term of this patent is extended or adjusted under 35 U.S.C. 154(b) by 0 days.

(21) Appl. No.: 16/531,028

(22) Filed: Aug. 3, 2019

Related U.S. Application Data

(60) Provisional application No. 62/715,490, filed on Aug. 7, 2018.

(51) Int. Cl.
*B63B 17/00* (2006.01)
*B63B 27/14* (2006.01)

(52) U.S. Cl.
CPC ..... *B63B 27/14* (2013.01); *B63B 2231/00* (2013.01)

(58) Field of Classification Search
CPC ... B63B 27/00; B63B 27/146; B63B 2231/00; B63B 27/14; E06C 1/56
USPC ..... 114/343, 362, 363, 364
See application file for complete search history.

(56) References Cited

U.S. PATENT DOCUMENTS 3,464,517 A * 9/1969 Akermanis ..... B63B 27/146 182/97
4,742,795 A * 5/1988 DePrey ..... B63B 19/08 114/343
5,924,521 A * 7/1999 Crockett ..... B63B 27/14 182/106
8,297,215 B1 * 10/2012 Chinn ..... B63B 17/04 114/362
8,356,568 B1 * 1/2013 Chinn ..... B63B 27/146 114/362
9,199,703 B1 * 12/2015 Svendsen ..... B63B 43/26
9,500,026 B2 * 11/2016 Mountain ..... E06C 1/56
9,745,026 B1 * 8/2017 Cummings ..... B63B 27/146

* cited by examiner

*Primary Examiner* — Daniel V Venne
(74) *Attorney, Agent, or Firm* — Thomas G. Ference

(57) ABSTRACT

An apparatus for aiding a person to get on and off a boat, the boat step apparatus has two side-rails and a step therebetween. The first side-rail is fixed to the step and the second side-rail is pivotally attached to the step. The apparatus is designed to hang off of the side-rail of a boat and give four stable points of contact along the outer hull side of the boat. The apparatus adjusts fit the shape of a hull of any boat.

15 Claims, 13 Drawing Sheets

BOAT STEP APPARATUS

CROSS-REFERENCE TO RELATED APPLICATIONS

This application claims the benefit of priority of U.S. Provisional Patent Application No. 62/715,490, filed Aug. 7, 2018, which is herein incorporated by reference. This patent application is related to U.S. Design patent application No. 29/659,213, filed on Aug. 7, 2018, and entitled "Boat Step Apparatus", which is incorporated herein by reference.

FIELD

The present invention generally relates to a step apparatus for temporary attachment to the hull of a boat to aid in getting on and off of the boat. More specifically, the invention relates to a step apparatus that has two side-rails with at least one step there between. The step apparatus is hung off the toe-rail of the boat. The side-rails pivot relative to each other to adjust to any curvature of the outer hull along the length of the boat and can therefore be used interchangeably between boats of different geometry.

BACKGROUND

Large pleasure boats and sail boats with lengths longer than 31 feet have decks that typically float 2-5 feet above the water. Getting on and off the boat to a deck safely can be problematic for older adults, smaller adults and children. The most dangerous situation is when the yacht docks anywhere other than its' home dock where a side tie is required. In this case someone has to quickly jump from the boat's side to the dock with a mooring line in hand leaving at best only one hand to aid in stability.

The current solution is to provide a side step to the boat. Generally three categories of side steps exist. The first category is rope step, a step hung off of the side of the boat by a swinging rope. This type of side step is usually attached to the boat by tying the top of the step with rope to stanchions. This type of step will adjust to the boat's geometry at the top, but can swing sideways and be unstable under foot. The second category is a rigid, attached step. This type of step is usually a temporary aluminum step assembly that can be hung from the boat's toe-rail. These ridged aluminum steps, which are typically more secure than rope, require considerable mechanical adjustment and time to get stability at four points of contact along the boats hull. These rigid steps can also ding the boats hull, sink if accidentally dropped into the water and are subject to corrosion and maintenance. Another problem is that any fixed geometry step built for a specific boat, though stable, will only properly fit in one location due to boat varying hull geometry along the side and not be readily available to move to other locations on the boat. The third category is a dock step that is placed on the dock next to the boat. However, these are bulky, difficult to store on the boat and if the boat is displaced a distance from the dock by bumpers there can be an unsafe gap to get on and off of the boat.

The present invention aims to eliminate the deficiencies of these prior steps.

SUMMARY

In one implementation, the present disclosure is directed to a boat step apparatus for aiding a person to get on and off of a boat, the boat having a hull with an outer hull side that is curved from fore to aft and a toe-rail mounted along the outer edge of the upper deck. The apparatus comprises a fixed side-rail and a pivoting side-rail, each side-rail having a toe-rail engaging end, a hull engaging end, a hull side, an access side, a step side and an outer side. Each side-rail has recess along the hull side from the toe-rail engaging end to the hull engaging end. The recess is critical so that the side-rail is disposed away from the boat hull except for contact at the toe-rail end and hull engaging end. The apparatus further comprises at least one step attached between the step side of the fixed and pivoting side-rails. The step is rigidly attached to the step side of the fixed side-rail and pivotally attached by a pivot mechanism to the step side of the pivoting side-rail.

BRIEF DESCRIPTION OF DRAWINGS

For the purposes of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
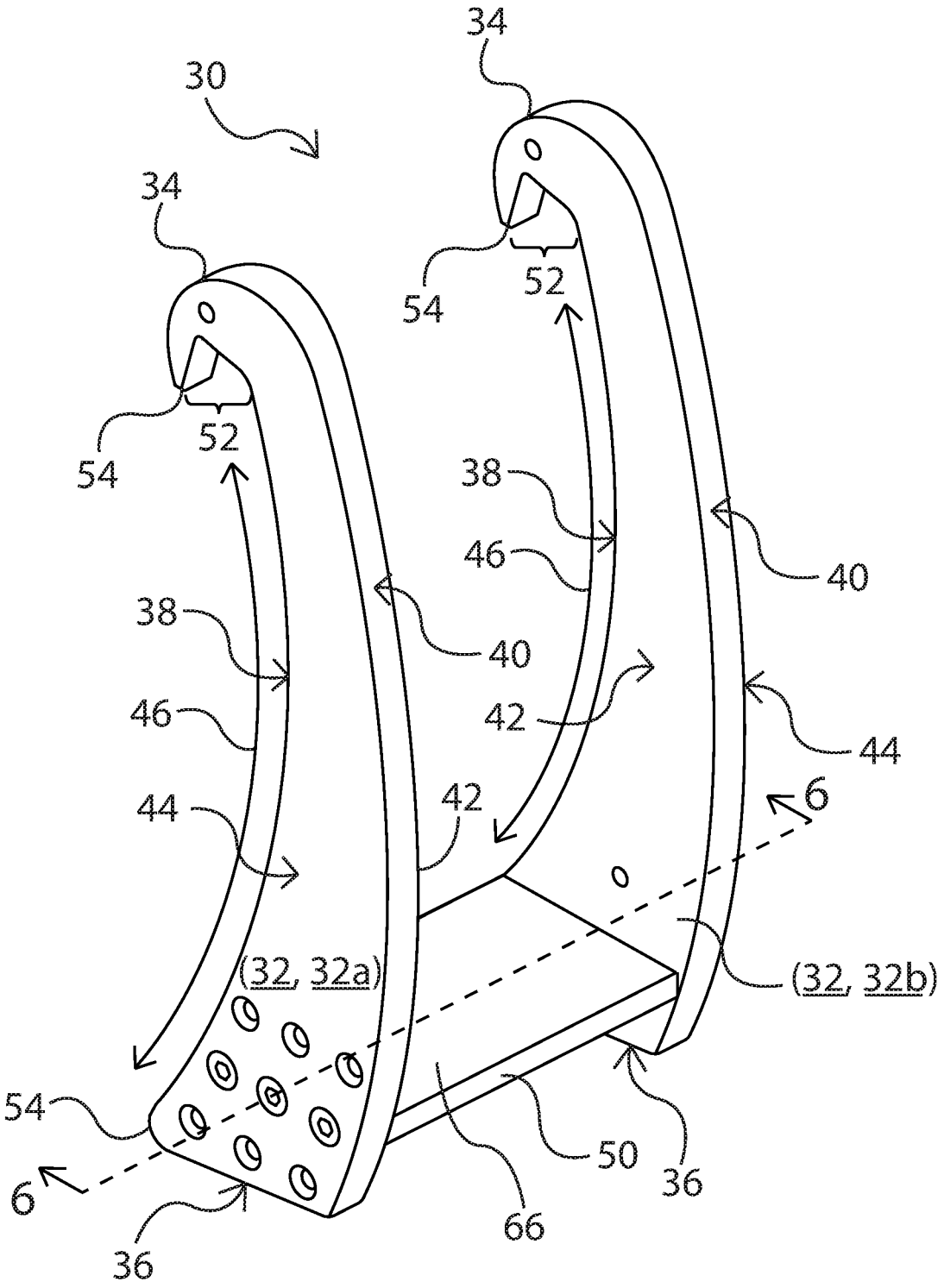
FIG. 1 is a perspective view of one exemplary embodiment of a boat step apparatus according to the present invention.
Figure 2:
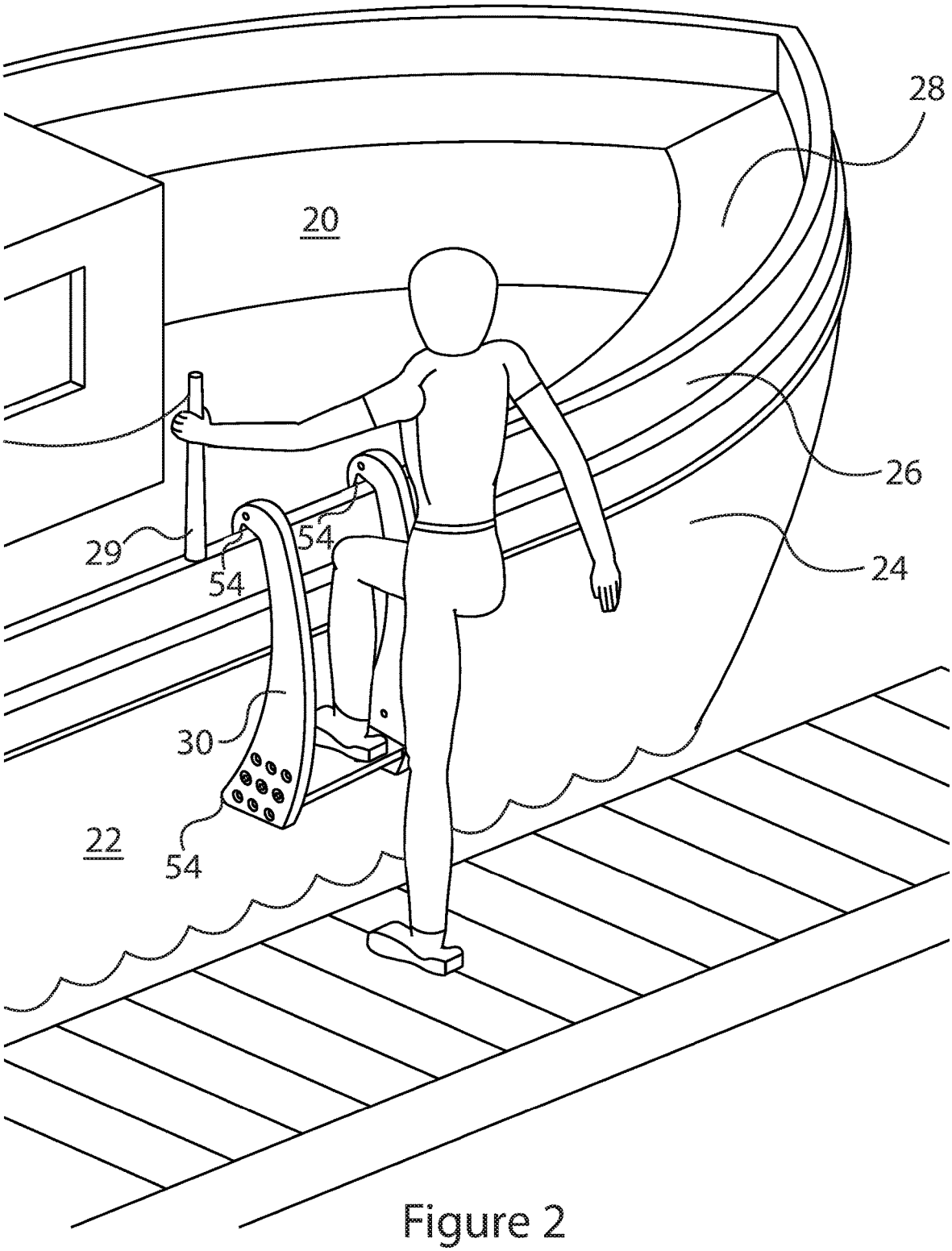
FIG. 2 is a perspective view of the step apparatus in FIG. 1 shown in use when attached to the side of a boat.
Figure 3:
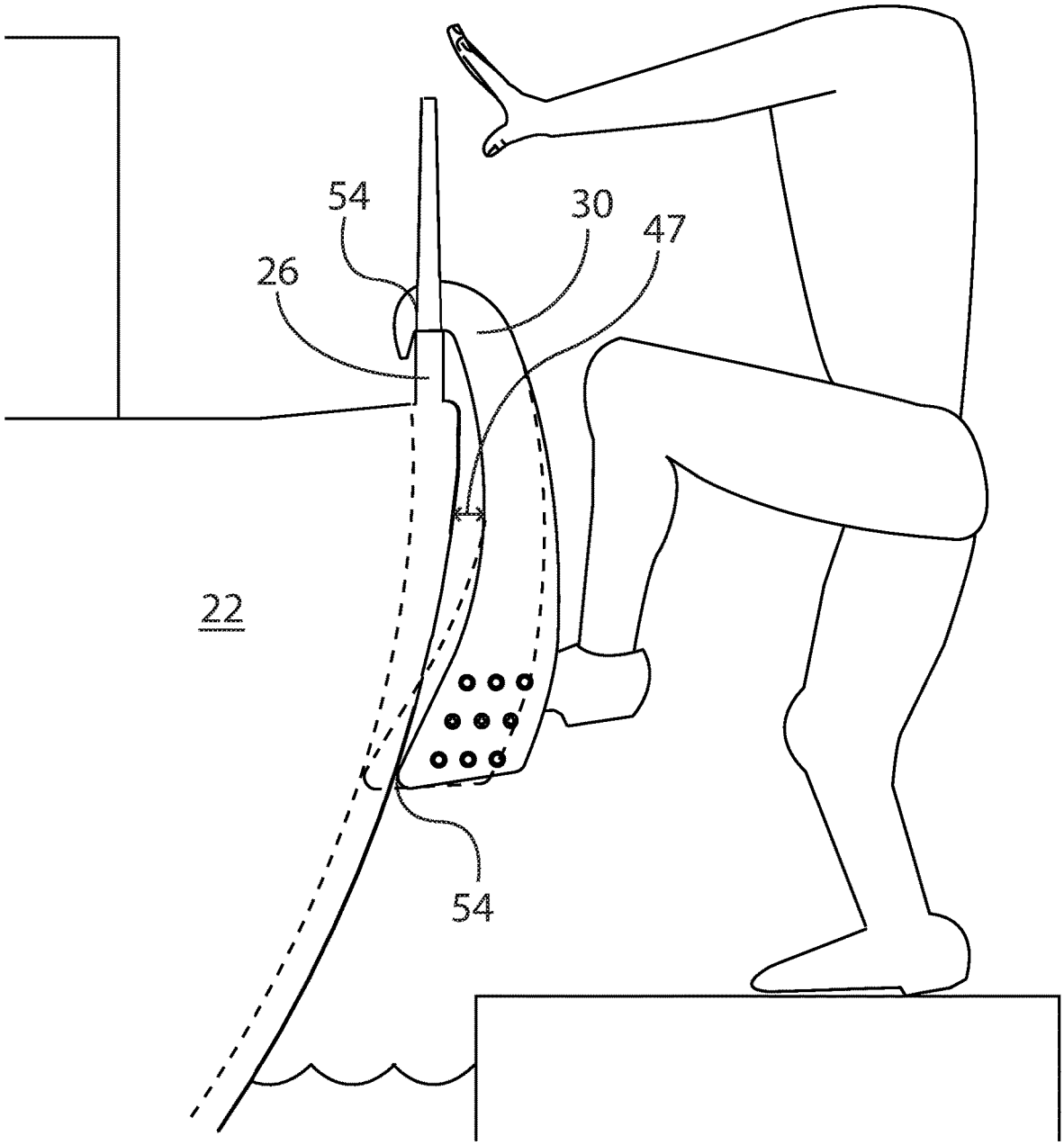
FIG. 3 is a side view of the step apparatus in FIG. 1 shown in use when attached to the side of a boat.
Figure 4:
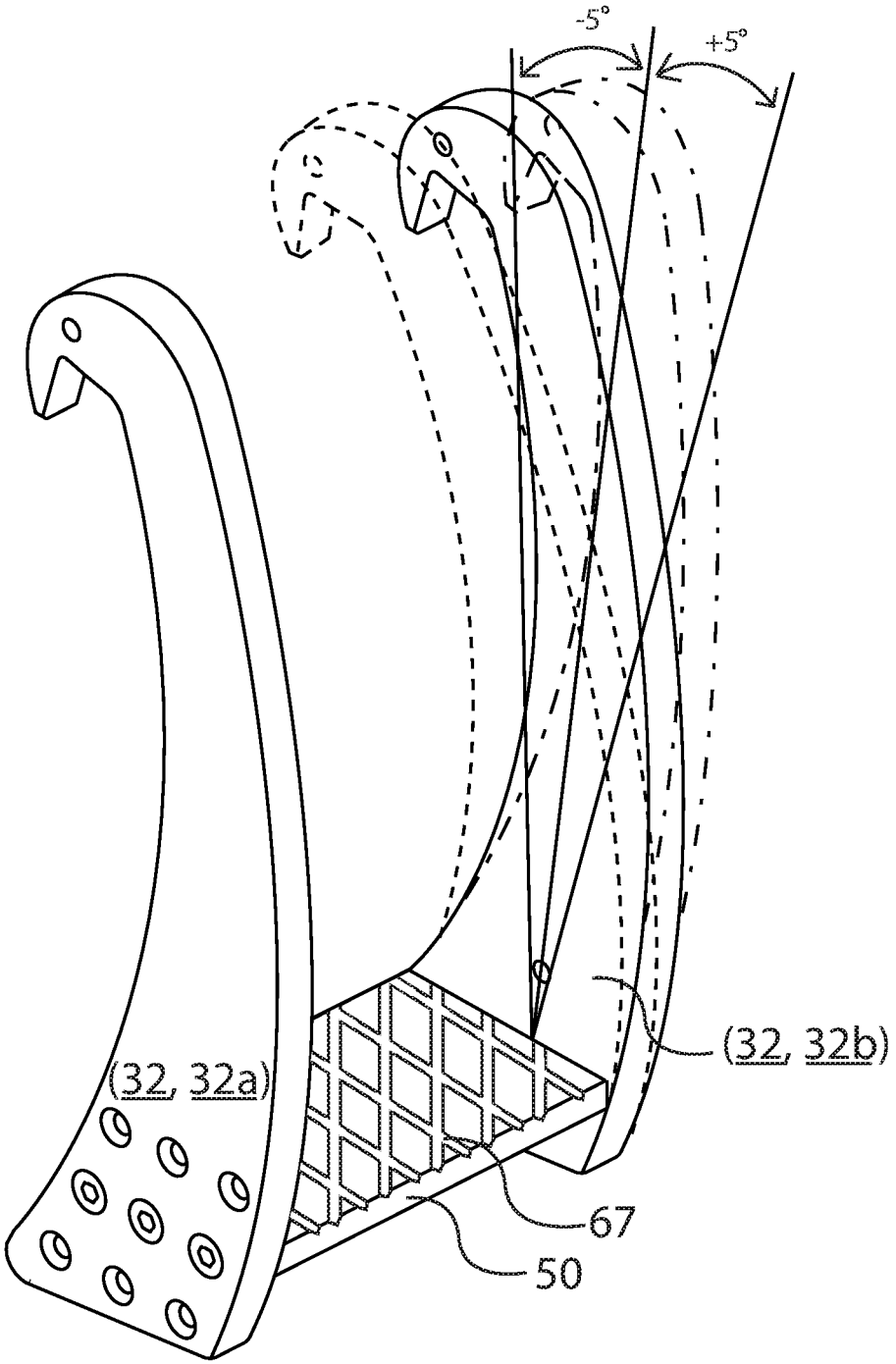
FIG. 4 is perspective view of the step apparatus of FIG. 1 showing self-adjustment capabilities of the step apparatus and non-slip surface on the step.
Figure 5:
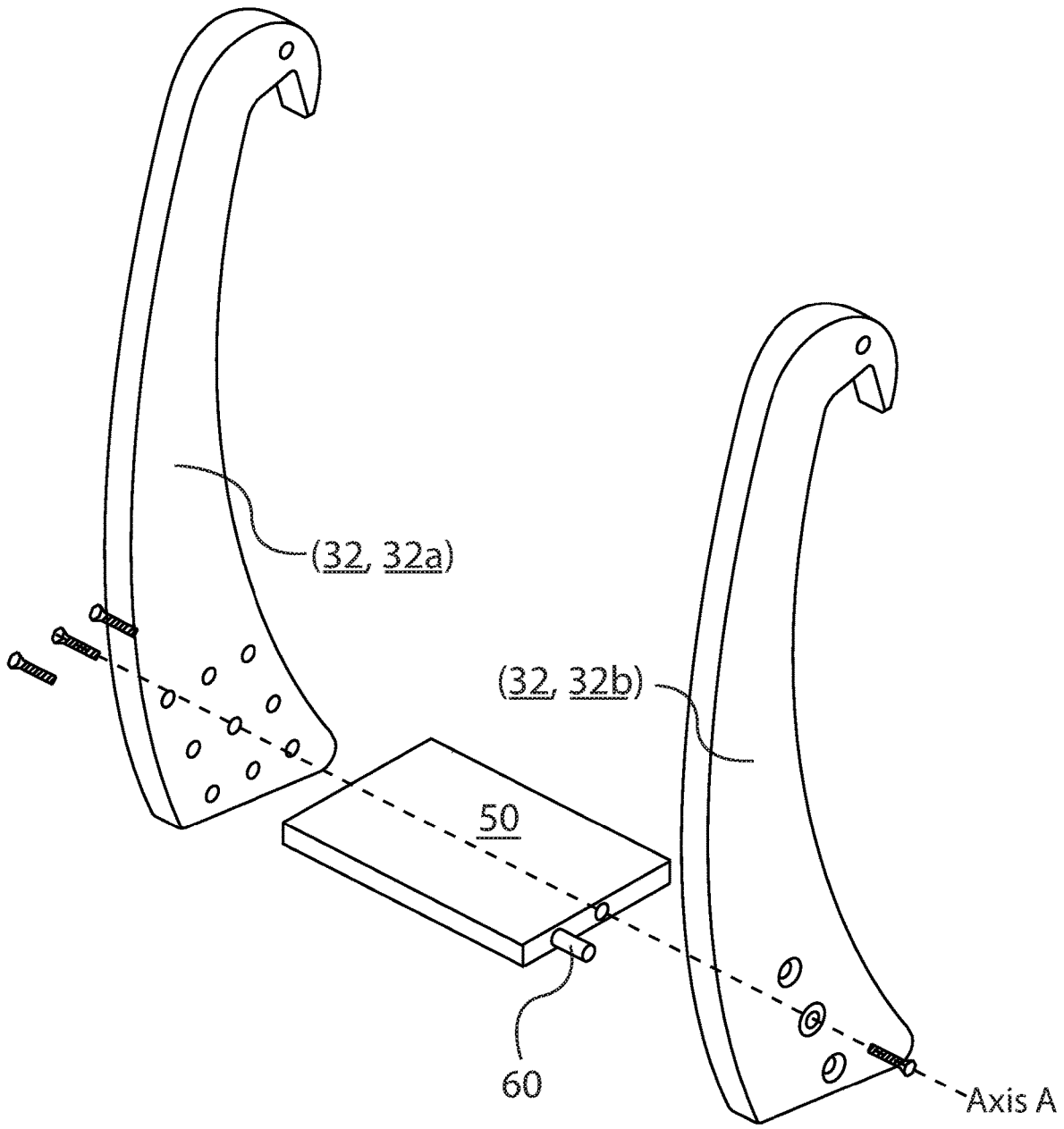
FIG. 5 is an exploded view of the apparatus of FIG. 1.
Figure 6:
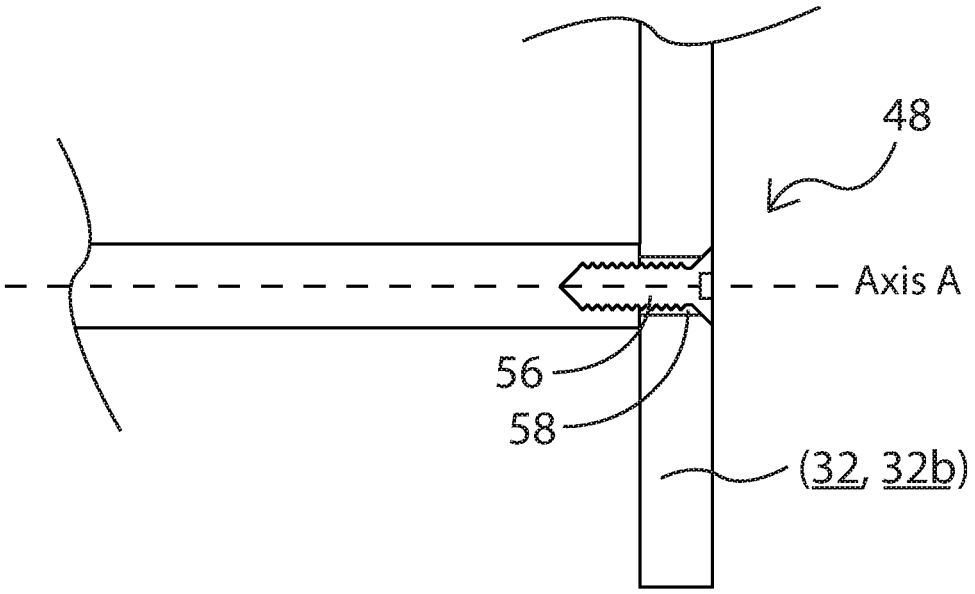
FIG. 6 is a sectional view along line 6-6 of FIG. 1.
Figure 7:
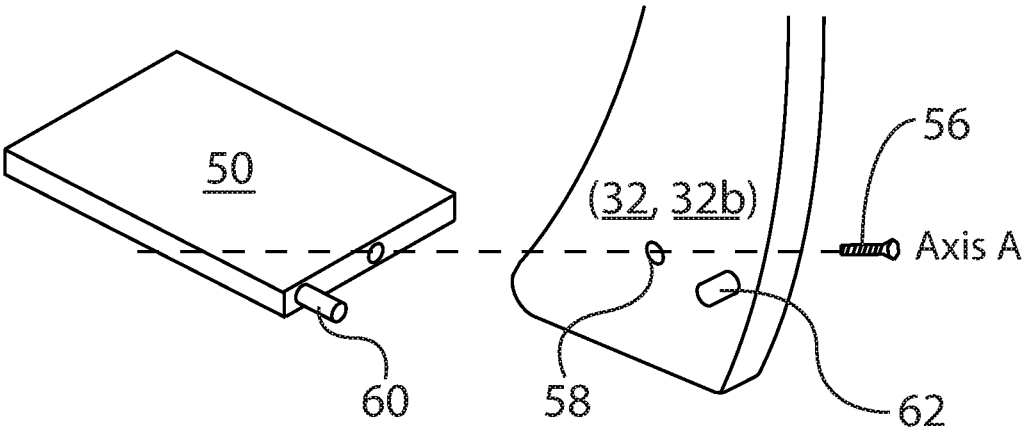
FIG. 7 is a fisheye, explode view of the pivot mechanism of FIG. 1.
Figure 8:
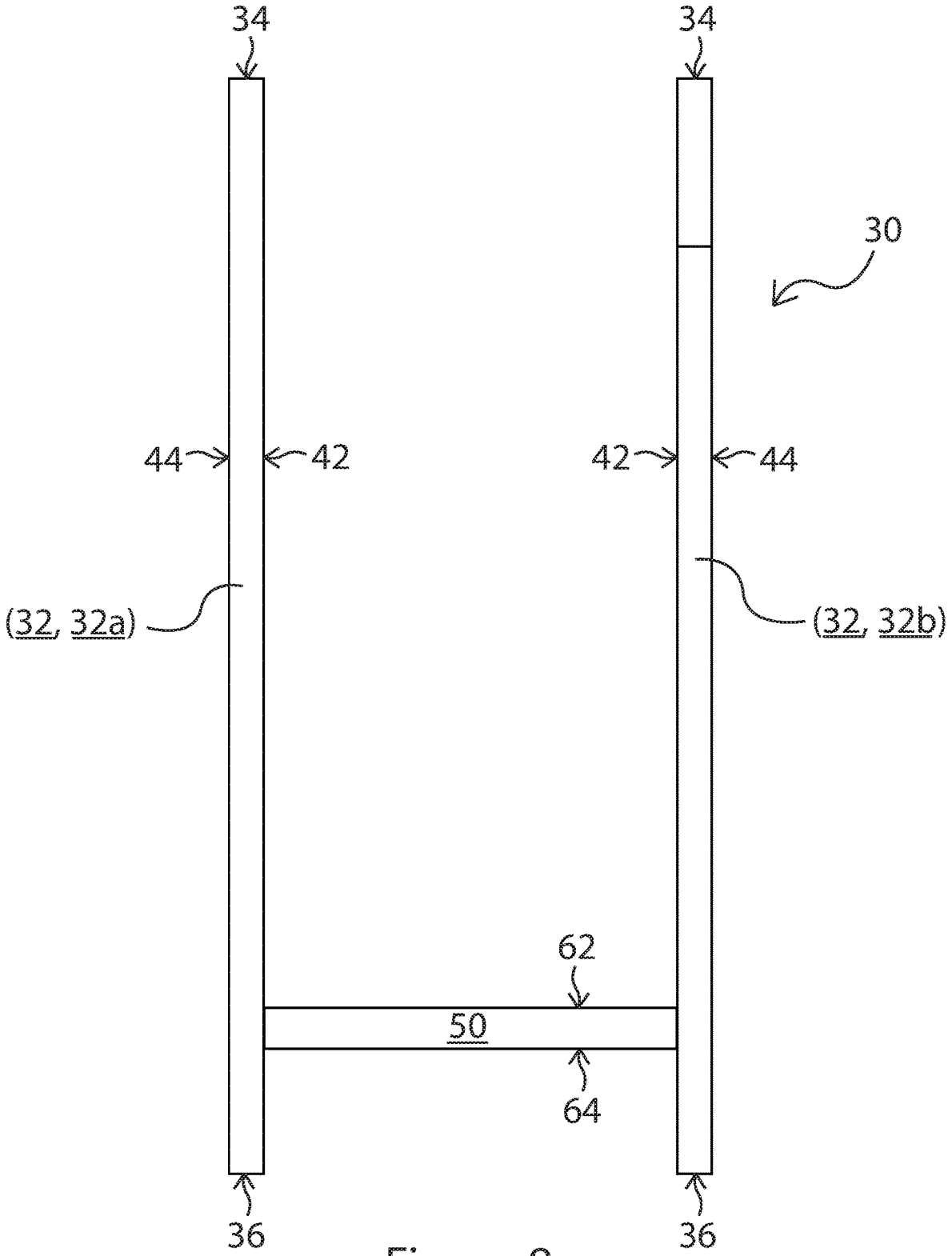
FIG. 8 is a front elevational view of the step apparatus of FIG. 1.
Figure 9:
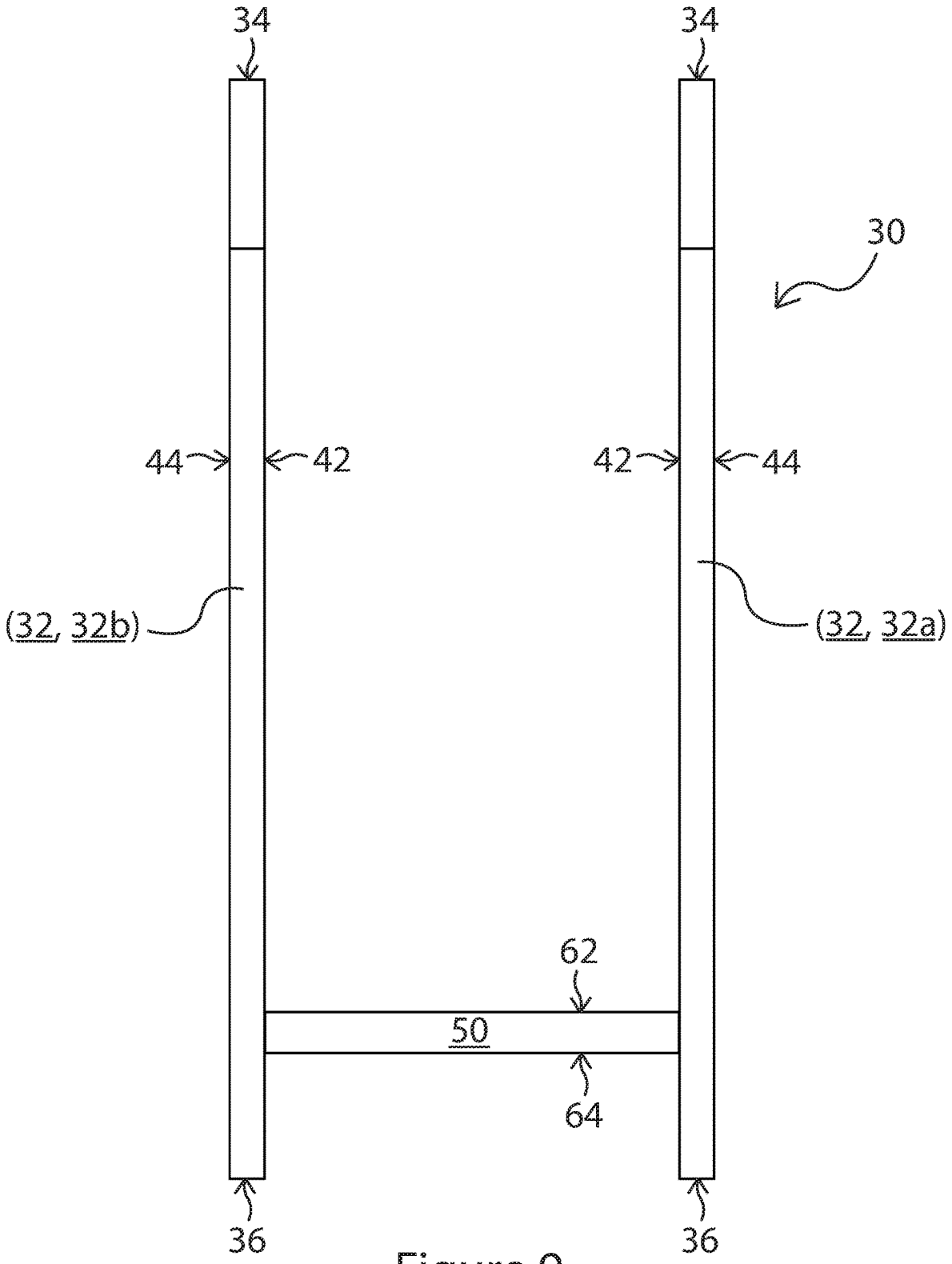
FIG. 9 is a back elevational view of the step apparatus of FIG. 1.
Figure 10:
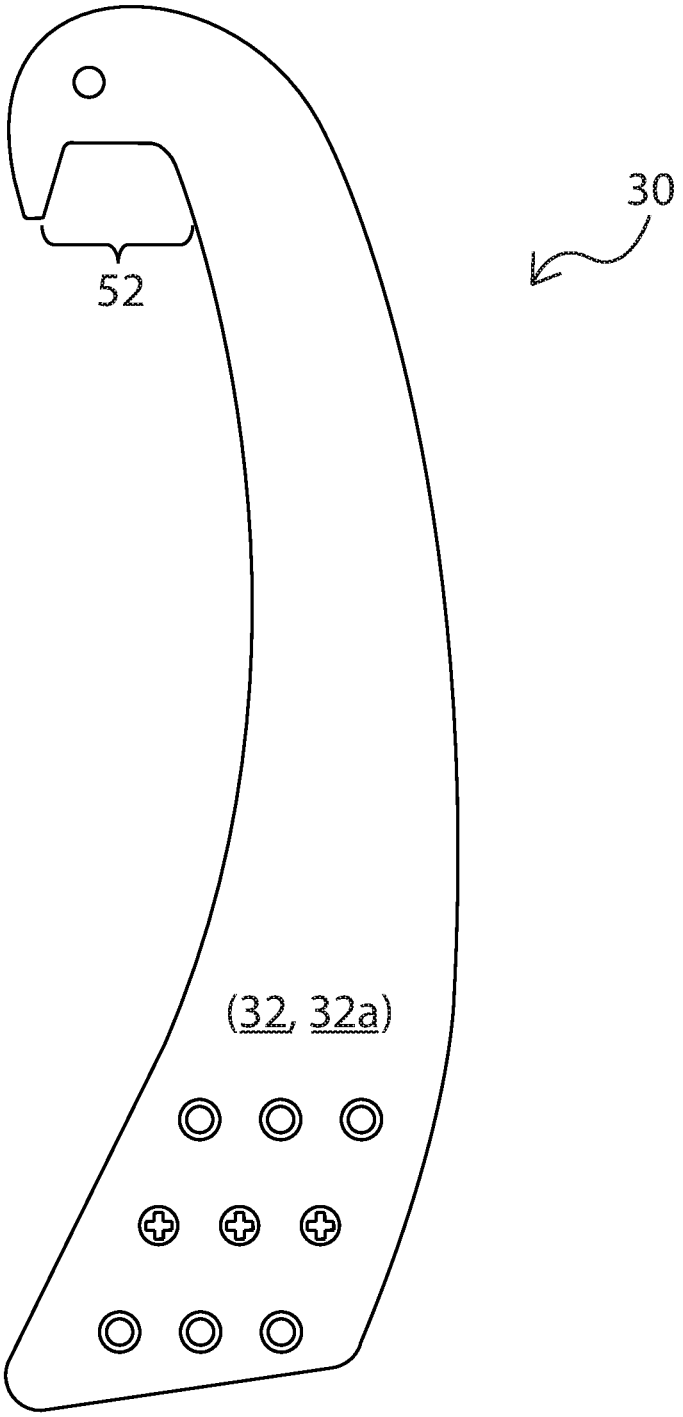
FIG. 10 is a left-side elevational view of the step apparatus of FIG. 1.
Figure 11:
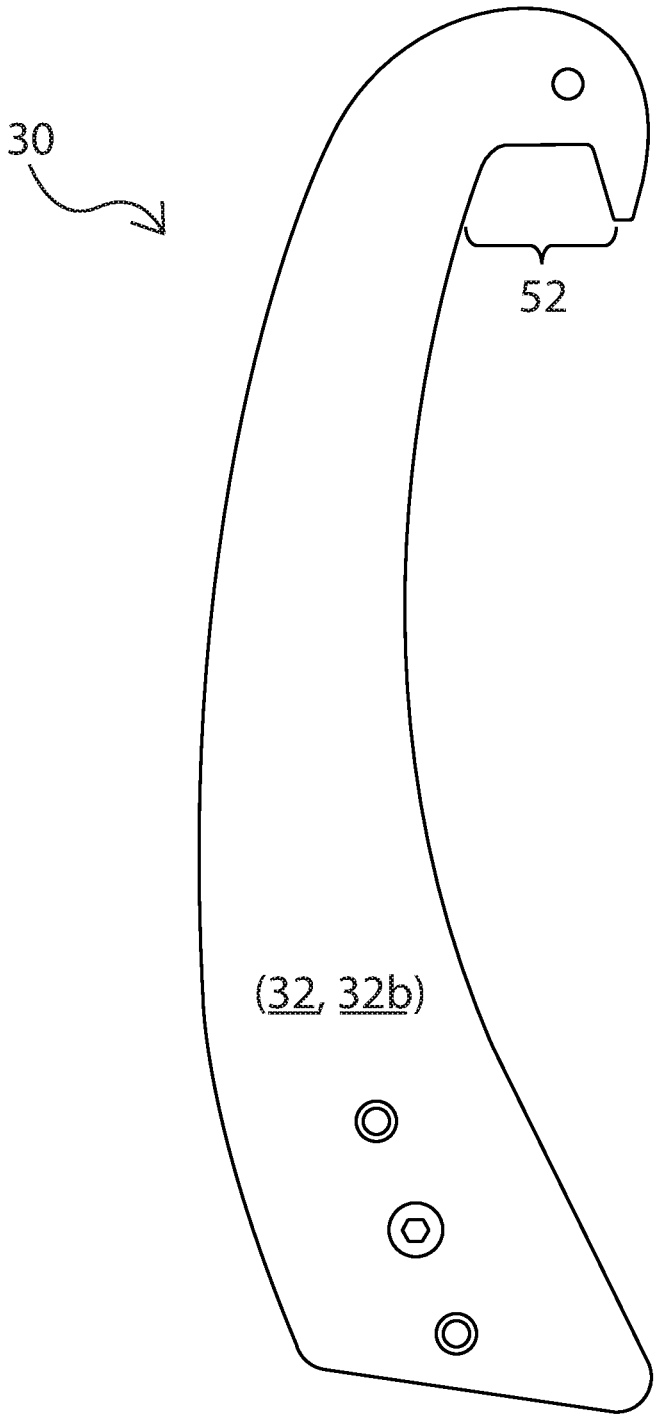
FIG. 11 is a right-side elevational view of the step apparatus of FIG. 1.
Figure 12:
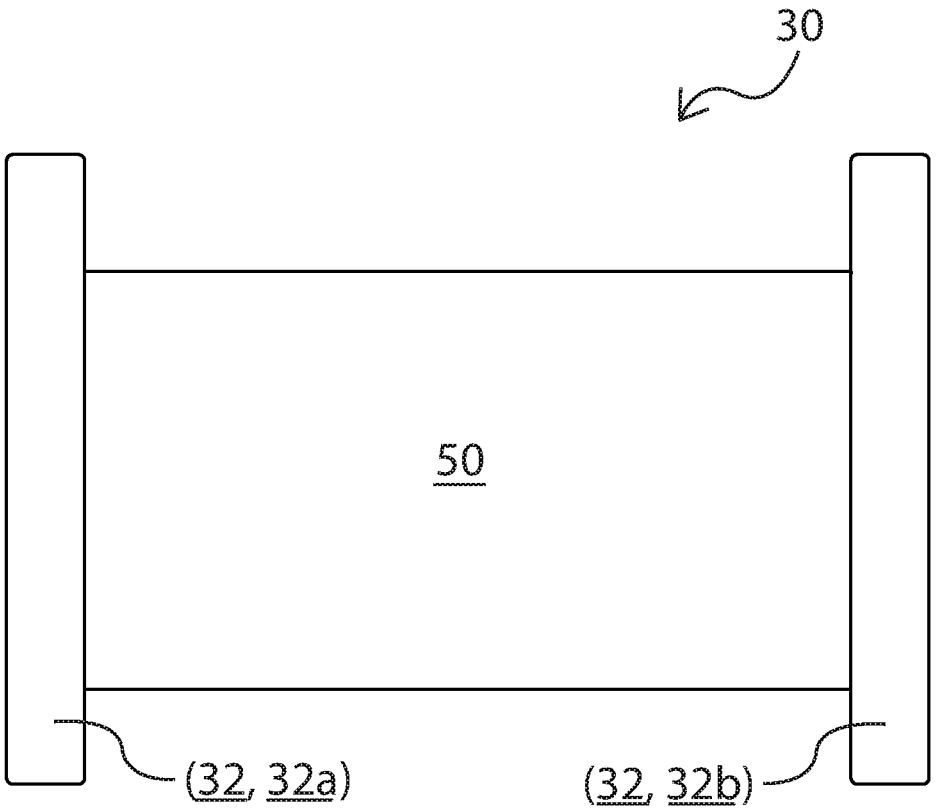
FIG. 12 is a top plan view of the step apparatus of FIG. 1.
Figure 13:
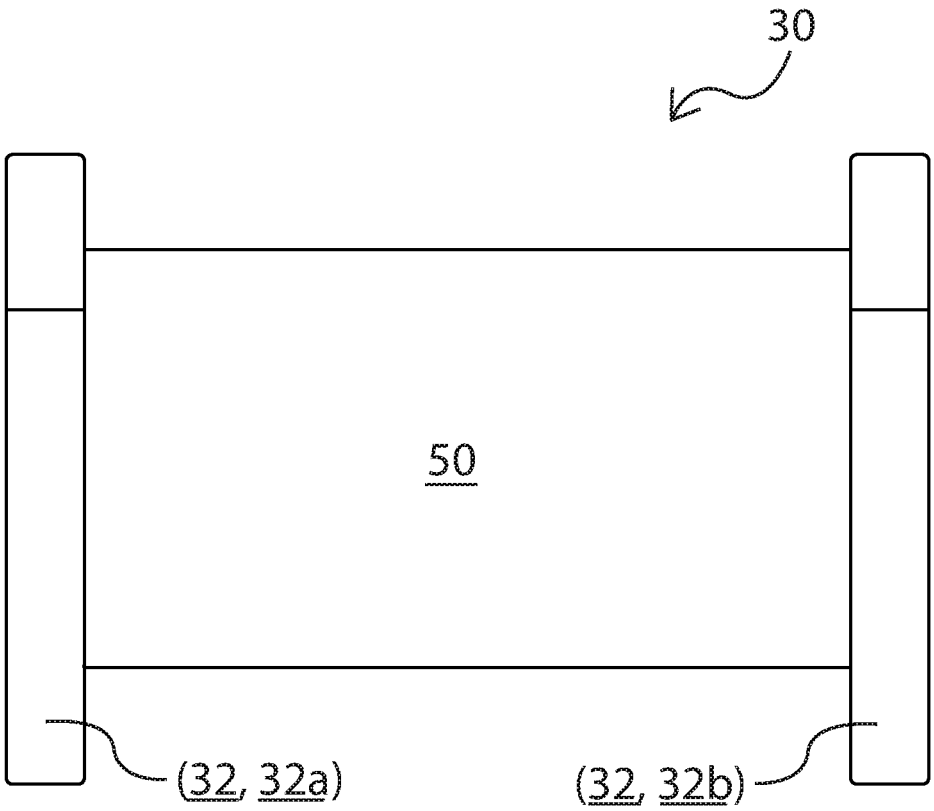
FIG. 13 is a bottom plan view of the step apparatus of FIG. 1.
Figures 14A, 14B:
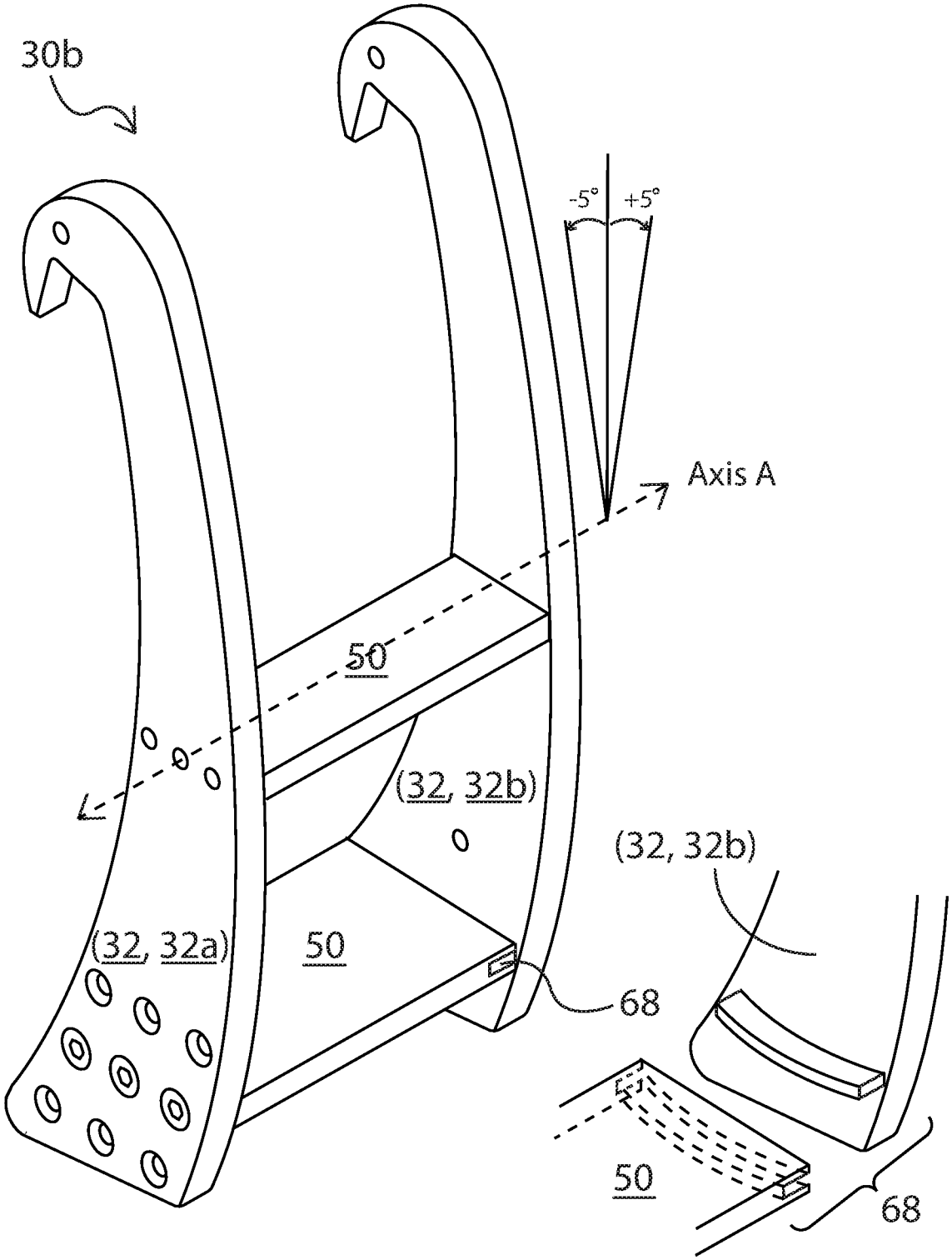
FIG. 14*a* is a perspective view of another embodiment of the step apparatus of FIG. 1 having two steps.
FIG. 14*b* is an exploded view showing components that allow the second step in FIG. 14 to have support and move in an arc.

Boat step apparatus 30 is illustrated in FIGS. 1-14. Apparatus 30 is configured for attachment to a boat 20 having a hull 22 with an outer hull side 24 that is curved from fore to aft, curved from deck to waterline and has a toe-rail 26 mounted along the outer edge of the upper deck 28. The boat may also have stanchions 29 along the outer edge of upper deck 28, FIG. 2. Apparatus 30, FIG. 1, comprises two side-rails 32 a fixed side-rail 32*a* and a pivoting side-rail 32*b*. Each side-rail 32 is defined by a toe-rail engaging end 34, a hull engaging end 36, a hull side 38, an access side 40, and step side 42 and an outer side 44.

Each side-rail 32 has a recess 47 along the hull side 38 from toe-rail engaging end 34 to the hull engaging end 36. Recess 47 preferably takes the form of an arc 46. Arc 46 may have substantially the same arc or greater arc than the hull of the boat. It is critical to dispose each side-rail away from the boat hull except for contact at the toe-rail end and the hull engaging end so as to minimize contact with the boat hull and prevent dinging and scratching of the boat. Apparatus 30 comprises at least one step 50 attached between step side 42 of both the fixed side-rail 32*a* and the pivoting side-rail 32*b*. The step is rigidly attached to the step side 42 of fixed side-rail 32*a* and pivotally attached by a pivot mechanism 48 to the step side 42 of pivoting side-rail 32*b*. It is understood that the fixed side and pivot mechanism side of apparatus 30 can be either the left side or the right side, but has been shown with only one orientation in the figures of this disclosure.

It is critical to have the boat step apparatus as a whole have a specific gravity of less than 1.0 so that if apparatus 30 accidentally falls into the water it will float. This is most easily done by having side-rails 32 and step 50 made of a material with a specific gravity less than 1.0 (density less than water). It is also critical that apparatus 30 should be made of a marine grade polymer with hardness less than the hardness of the boat so as not to ding boat. In general the fabrication material needs a durometer of seventy or less to be non-denting for most boat hull materials. Durometer is the international standard for measuring material hardness. The hardness is measured on a Shore D scale, which was developed by Albert Ferdinand Shore. It is also critical to have the apparatus be made of a UV resistant material that will not degrade over time due to exposure to sunlight. Apparatus 30 should also be designed to hold three hundred pounds with a safety factor generally greater that three. Use of the material KING STARBOARD® has been found to meet the above material criteria.

Both side-rails 32 have a hook 52 within hull side 38 for engaging toe-rail 26 of boat 20. Hook 52 is shaped generally to match the shape of toe-rail 26. Hook 52 is large enough to mate with most toe-rails 26 that may vary in size and shape from boat to boat. During use toe rail engaging end 34 of fixed side-rail 32*a* and toe rail engaging end 34 of pivoting side-rail 32*b* are both placed over toe-rail 26 of boat 20 to engage the toe-rail. Once engaged with the toe-rail, the side-rails 32 pivot relative to each other so that the hull-side ends of both side-rails engage the curved outer hull side of the boat hull. This self-adjustment pivoting creates four points of contact 54 with boat hull 22 and allows for a stable step to be generated on the side of boat 20 independent of where apparatus 30 is placed along the boat hull or what boat the apparatus is placed on, FIG. 4.

Fixed side of apparatus 30 includes fixed side-rail 32*a* that is rigidly fastened to step 50. Fastening may occur as shown with three screws that can be adjusted to different heights. Fixed side-rail 32*a* may also be welded or adhered to step 50.

Pivot mechanism 48 may take on various configurations. In one exemplary embodiment, pivot mechanism 48 includes a pivot pin 56 along a pivot axis A. Pivot pin 56 is engaged between step 50 and pivoting side-rail 32*a*. Pivot pin 56 may be a threaded screw that is screwed in to step 50, yet freely rotates with pivot opening 58 within pivoting side-rail 32*b*. Pivot mechanism 48 may include a rotation limit pin 60 that fits within a rotation limit slot 62. Rotation limit pin 60 is spaced a distance away from pivot axis A. Rotation limit pin is engaged between step 50 and pivoting side-rail 32*b*. Rotation limit pin 60 limits the amount of rotation that can occur between the two side-rails 32. This rotation is generally plus or minus five degrees or less.

Apparatus 30 may have further features. For example in one embodiment side-rails 32 may be adjustable in length. In another embodiment step 50 has a top surface 62 and a bottom surface 64. Top surface 62 has a non-slip surface 66. Non-slip 66 surface may be any highly textured surface such as an applied traction grit, a dot pattern or a diamond grooved pattern 67 for creating traction and draining water. In yet another embodiment, apparatus 30*b* comprises two or more steps to work on larger boats, FIG. 14*a*. One step has a pivot axis A similar to that shown and described for the one step embodiment above. The second or more steps have a curved slide support 68 (or other similar mechanism) that supports the second (or more steps) and provides a means for that step to slip in an arc around the pivot axis, FIG. 14*b*.

While several embodiments of the invention, together with modifications thereof, have been described in detail herein and illustrated in the accompanying drawings, it will be evident that various further modifications are possible without departing from the scope of the invention. The scope of the claims should not be limited by the preferred embodiments set forth in the examples, but should be given the broadest interpretation consistent with the description as a whole.

What is claimed is:

1. A boat step apparatus for aiding a person to get on and off a boat; the boat having a hull with outer hull side that is curved from fore to aft and a toe-rail mounted along an outer edge of the upper deck, comprising:

a) a fixed side-rail and pivoting side-rail, each fixed side-rail and pivoting side-rail having a toe-rail engaging end, a hull engaging end, a hull side, an access side, a step side and an outer side; each fixed side-rail and pivoting side-rail has a recess along the hull side from the toe-rail engaging end to the hull engaging end that generally disposes each fixed side-rail and pivoting side rail away from the boat hull except for contact at the toe-rail engaging end and the hull engaging end; and b) at least one step attached between the step side of the fixed and pivoting side-rails;

wherein the at least one step is rigidly attached to the step side of the fixed side-rail and pivotally attached by a pivot mechanism to the step side of the pivoting side-rail.

2. The boat step apparatus as recited in claim 1, wherein the toe-rail end of each fixed side-rail and pivoting side-rail has a hook within the hull side for engaging with the toe-rail on the boat.

3. The boat step apparatus as recited in claim 2, wherein when both toe-rail engaging ends are placed over the toe-rail of the boat, the side-rails pivot relative to each other so that the hull-side ends of both the fixed side-rail and pivoting side-rail engage the curved outer hull side of the hull.

4. The boat step apparatus as recited in claim 3, wherein the pivot mechanism includes a pivot pin along a pivot axis and a rotation limit pin spaced a distance from the pivot axis, wherein the at least one step has a length and the pivot axis lies along the length of the at least one step.

5. The boat step apparatus as recited in claim 4, wherein the pivot pin is engaged between the at least one step and pivoting side-rail.

6. The boat step apparatus as recited in claim 5, wherein the rotation limit pin is engaged between the at least one step and pivoting side-rail.

7. The boat step apparatus as recited in claim 1, wherein the apparatus as a whole has a density less than the density of water so that the apparatus can float if dropped in the water.

8. The boat step apparatus as recited in claim 1, wherein the recess is an arc, wherein the arc along the hull side is greater than or equal to the curve of the hull of the boat.

9. The boat step apparatus as recited in claim 1, wherein said step has a top surface and a bottom surface, wherein said top surface has is a non-slip surface.

10. The boat step apparatus as recited in claim 9, wherein said non-slip surface is a diamond grooved pattern for creating traction and draining water.

11. The boat step apparatus as recited in claim 1, comprising two steps attached between the step side of the fixed and pivoting side-rails.

12. The boat step apparatus as recited in claim 11, wherein one step has the pivot mechanism and the other step has a sliding slot mechanism.

13. The boat step apparatus as recited in claim 1, wherein the apparatus is made of a UV resistant material.

14. The boat step apparatus as recited in claim 1, wherein the fixed side-rail and pivoting side-rail are made from a material of 70 or less Shore D durometer.

15. The boat step apparatus as recited in claim 1, wherein the recess is an arc along the hull side from the toe-rail engaging end to the hull engaging end that generally disposes each fixed side-rail and pivoting side-rail away from the boat hull except for contact at the toe-rail engaging end and the hull engaging end.

* * * * *